United States Patent [19]

Hardy

[11] Patent Number: 4,458,964

[45] Date of Patent: Jul. 10, 1984

[54] DRAWERS AND DRAWER ASSEMBLIES

[75] Inventor: Terence Hardy, Belper, England

[73] Assignee: L.B. (Plastics) Limited, England

[21] Appl. No.: 280,196

[22] Filed: Jul. 6, 1981

[30] Foreign Application Priority Data

Jul. 11, 1980 [GB] United Kingdom ..... 8022770

[51] Int. Cl.[3] ..... A47B 63/02; F16C 21/00; F16C 35/02

[52] U.S. Cl. ..... 312/330 R; 312/333; 312/338; 312/344; 312/348; 308/3.8

[58] Field of Search ..... 312/330 R, 333, 338, 312/344, 345, 346, 347, 348; 308/3.8

[56] References Cited

U.S. PATENT DOCUMENTS

| | | | |
|---|---|---|---|
| 747,685 | 12/1903 | Coye | 312/330 R |
| 962,502 | 6/1910 | Elmborg | 308/3.8 |
| 1,944,477 | 1/1934 | Tillotson, Jr. | 312/348 |
| 2,859,070 | 11/1958 | Gomersall | 308/3.8 |
| 2,880,040 | 3/1959 | Gomersall | 308/3.8 |
| 3,456,996 | 7/1969 | Heiniger-Schar | 312/347 |
| 3,610,719 | 10/1971 | Alston | 312/330 R |
| 3,954,315 | 5/1976 | Sanden | 312/344 |
| 4,037,885 | 7/1977 | Rock et al. | 308/3.8 |
| 4,162,114 | 7/1979 | Litchfield et al. | 312/330 R |
| 4,196,943 | 4/1980 | Rock et al. | 308/3.8 |
| 4,227,750 | 10/1980 | Rock et al. | 308/3.8 |
| 4,272,139 | 6/1981 | Fler | 312/333 |

FOREIGN PATENT DOCUMENTS

| | | | |
|---|---|---|---|
| 107273 | 4/1942 | Fed. Rep. of Germany | 312/338 |

*Primary Examiner*—Victor N. Sakran

*Attorney, Agent, or Firm*—W. Thad Adams, III

[57] ABSTRACT

A drawer has longitudinally extending tracks in its opposite sides, each of which is adapted to co-operate with a drawer runner mounted in a cabinet in which the drawer is supported in use, a roller carriage being engaged in each track and co-operable with the associated runner to support the drawer on the runner, the roller carriage being freely movable relative to the track and the runner, and each of the tracks incorporating means to stabilize the drawer against rocking or tilting movement about the roller carriage during opening and closing. One form of stabilizing means comprises a shelf raised from the base of the associated track and extending rearwardly from the forward end thereof to engage beneath the runner and prevent upward movement of the front of the drawer during initial opening and final closing movement.

12 Claims, 9 Drawing Figures

DRAWERS AND DRAWER ASSEMBLIES

This invention relates to drawers and especially to drawers of the kind which are adapted to be slidably mounted on a pair of runners fixed to a cabinet or like support structure by means of intermediate roller assemblies or carriages which are movable relative to the drawer and the associated runners during opening and closing movements of the drawer.

Drawers of this kind have a smooth opening and closing action but suffer from certain disadvantages. In particular the drawer tends to rock or tilt about the roller assembly at certain positions during opening and closing and this can cause mal-functioning of the roller assembly, particularly if the drawer is heavily laden at the rear or if the user tends to lift the front of the drawer during opening and closing movements.

It is an object of the present invention to provide a means whereby this disadvantage may be obviated or mitigated.

The invention provides a drawer having longitudinally extending tracks in its opposite sides, each of which is adapted to co-operate with a drawer runner mounted in a cabinet in which the drawer is supported in use, each of said tracks incorporating means to stabilise the drawer against rocking or tilting movement during opening and closing.

Preferably said means to stabilise the drawer comprises formations formed within the respective drawer tracks and operative to engage with the associated runners to prevent lifting movement of the front of the drawer until it has been withdrawn from the cabinet to a predetermined extent.

Each formation may comprise a shelf raised from the base of the associated track and extending rearwardly from the forward end thereof, the shelf being adapted to engage beneath and prevent upward movement of the track and hence the drawer relative to the associated runner during initial opening and final closing movement of the drawer. Alternatively each formation may comprise a projection on or adjacent the base of the associated track towards the forward end thereof.

The tracks in the drawer sides may be formed integrally with the sides of the drawer but are preferably formed as separate components engaged and retained in recesses in the drawer sides. In this case the drawer sides are preferably of hollow section and formed by extrusion from synthetic plastics material, the inserts also being formed from plastics material by a moulding process. The tracks may be provided with additional formations serving as stops, self closing devices and the like.

The drawer sides preferably incorporate longitudinal slots in the faces thereof opposite to those in which said recesses are formed, the slots receiving the edges of the drawer bottom.

Preferably the drawer sides are connected to the front and back walls of the drawer by means of connecting pieces having projecting spigots which engage in the hollow ends of the side walls and are suitably retained therein. For example, the spigots may be retained by means of detents projecting therefrom and engaging in holes formed adjacent the ends of the side walls.

The invention also provides a drawer runner insert comprising an elongated member adapted to be engaged and retained in a recess in a drawer side to form a runner track and incorporating means to stabilize the drawer against rocking or tilting movement during sliding movement of the drawer relative to an associate runner engaged in said track.

Embodiments of the invention will now be described, by way of example only, with reference to the accompanying drawings, in which.

Figure 1:
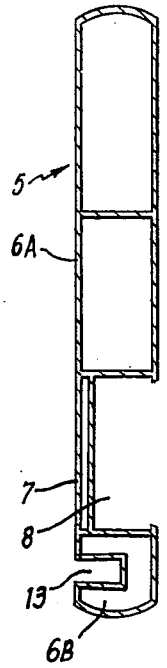
FIG. 1 is a cross-section through a drawer side wall panel.
Figure 2:
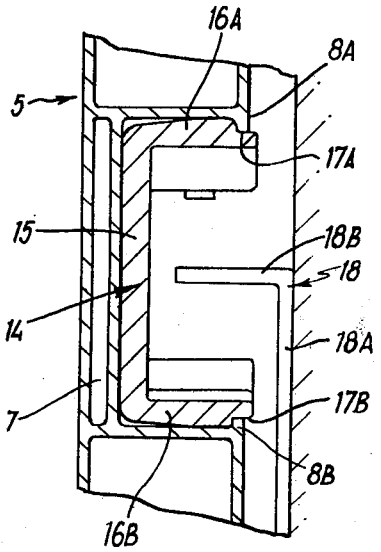
FIG. 2 is an enlarged fragmentary cross-section showing the wall panel fitted with an insert defining a runner track and mounted in operative association with a runner secured to a cabinet or the like in which the drawer is mounted in use.
Figure 3:
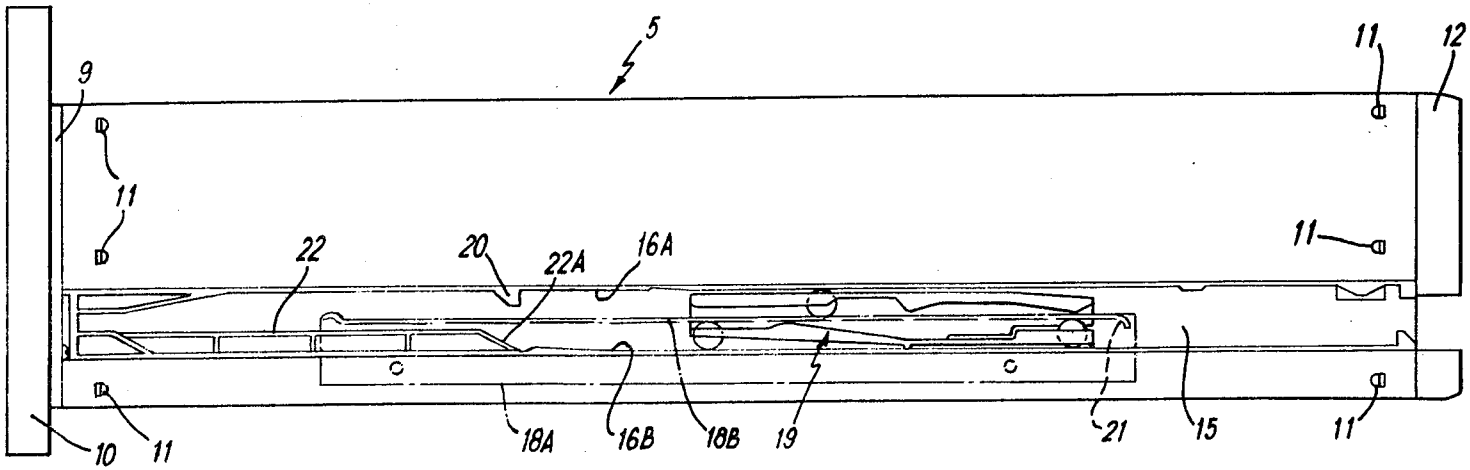
FIG. 3 is a side elevation of the arrangement shown in FIG. 2.

Referring to FIGS. 1 to 3 a drawer incorporates side wall panels 5 in the form of hollow section profiles having upper and lower sections 6A and 6B interconnected by a hollow web 7 which defines, together with the upper and lower sections, a recess 8 extending longitudinally of the panel and formed on the face thereof which is outermost in use.

The side wall panels are assembled with other panel members to form a drawer by means of front and rear connecting pieces. Each front connecting piece one of which is partly visible in FIG. 3 comprises a face plate 9 adapted to be secured by screws or the like to a drawer front 10 and having rearwardly projecting spigots (not shown) each of which carries a projecting detent 11. The spigots are adapted to form a close push fit within the hollow end of the associated side wall panel 5 and the detents engage in holes formed adjacent the ends of the panel. The rear connectors one of which is partly visible at 12 in FIG. 3 are provided with similar spigots and detents but are in the nature of corner pieces having spigots projecting in two directions at right angles so as to be engageable in the ends of two adjacent panel members to connect them at right angles to one another to form a side and the back of the drawer. A longitudinal slot 13 is provided in the inwardly directed face of each panel member to receive the edge of a drawer bottom.

The recesses 8 in the side wall panels are each adapted to receive and retain a separate insert 14 (FIGS. 2 and 3) defining a runner track. The insert is of moulded plastics construction and of generally U-shaped cross-section so as to be received within the recess in the panel member.

The insert commprises a back wall 15 and upper and lower walls 16A and 16B which define a track adapted in use to receive a runner assembly on which the drawer is mounted. The outer edges of the upper and lower walls 16A, 16B are provided with longitudinal grooves 17A and 17B respectively which engage with longitudinally extending lips 8A, 8B projecting from the upper and lower edges of the recess 8. In this way the insert may be pressed into the recess 8 or slid in from one end, the lips 8A and 8B retaining the insert against lateral withdrawal from the recess.

In use the drawer is mounted on a pair of angle section runners one of which is shown at 18 in FIG. 2 and comprises a vertical flange 18A by means of which the runner may be secured to the wall of a cabinet or the like and a horizontal flange 18B which projects into the track formed by the insert 14. A roller assembly or carriage shown at 19 in FIG. 3 but omitted from FIG. 2 for clarity acts between the flange 18B and the upper and lower walls 16A and 16B of the insert 14 to support the drawer on the runner. The roller assembly also incorporates rollers (not shown) which run against the back wall 15 of the insert 14. The roller carriage 19 is freely movable relative to the runner and the drawer within limits defined by a stop member 20 projecting into the track defined by the insert 14 and a further stop member 21 on the runner 18. Other formations are also formed with the insert 14 to act upon the roller carriage to perform self-closing or other desired functions.

Towards its forward end the track defining insert 14 is provided with a formation in the nature of a shelf 22 (FIG. 3) which is raised from the base or lower wall 16 B and extends rearwardly for about one third of the length of the insert. At its rear end the formation 22 is provided with a tapered portion or ramp 22A extending downwards to the floor 16B. The formation 22 is raised from the floor 16B by a distance such that it locates closely beneath the flange 18B of the runner 18 when the drawer is approaching its closed position. This prevents the front of the drawer from rising in this position and this in turn prevents the roller carriage 19, which is then located at the rear of the runner 18 from disengaging from or jumping off the runner and thereby causing malfunction. The rear end of the flange 18B of the runner carries the stop member 21 which limits rearward travel of the roller carriage 19 and if the drawer is permitted to rock or tilt the rear roller of the carriage can in some circumstances and especially if the drawer is heavily loaded at the rear, be forced past the stop member 21. This locks the roller carriage to the runner and prevents further opening or re-opening of the drawer. By virtue of the provisions of the formation 22 within the track in the drawer side the drawer is stabilised against excessive rocking or tilting movement, thereby ensuring proper operation of the roller carriage.

Figure 4:
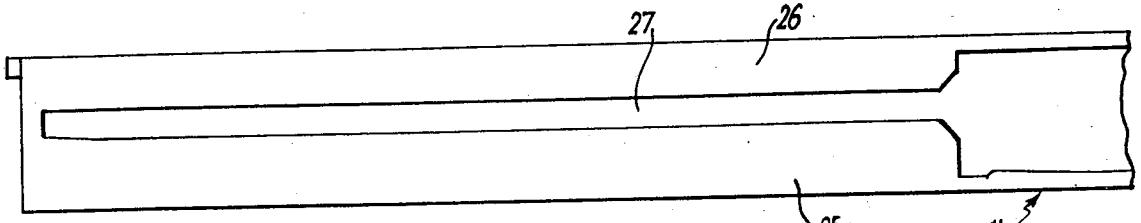
FIGS. 4 to 8 are fragmentary side elevations showing the forward portions of alternative forms of runner insert according to the invention.
Figure 5:
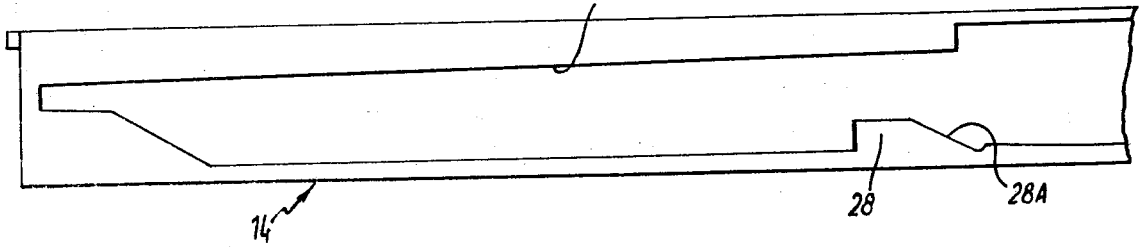

FIGS. 4 to 8 illustrate a number of alternative ways of stabilizing the drawer against rocking or tilting movement. In FIG. 4 a modified form of shelf 25 is provided which extends horizontally rearwards from the front end of the track defining or runner insert 14. The stop member 20 of the FIG. 3 arrangement is also extended forwardly to the front of the insert as shown in 26 whereby a relatively narrow track or slot 27 is defined to receive and guide the forward end of the runner. In FIG. 5 the upper extension 26 of FIG. 4 is retained but the shelf 25 is replaced by a projection 28 extending upwardly from the floor 16B of the insert 14 in a position corresponding to the rear end of the shelf 25. The projection has a rearwardly directed sloping face 28A which acts as a ramp or cam to pick up the forward end of the runner during opening of the drawer and hence prevent or reduce rocking or tilting movement in the same manner as the shelf.

Figure 6:
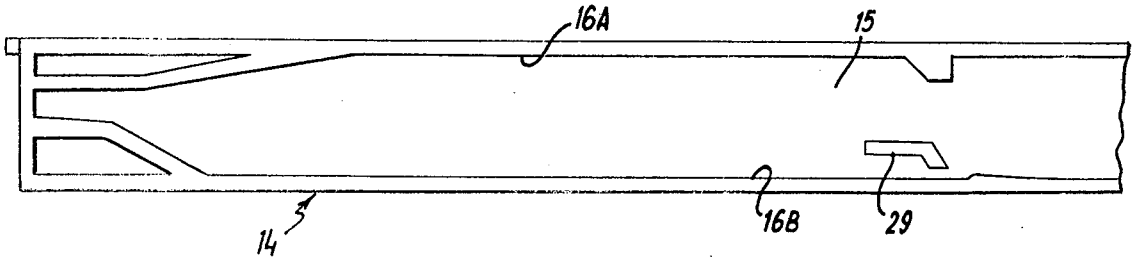
Figure 7:
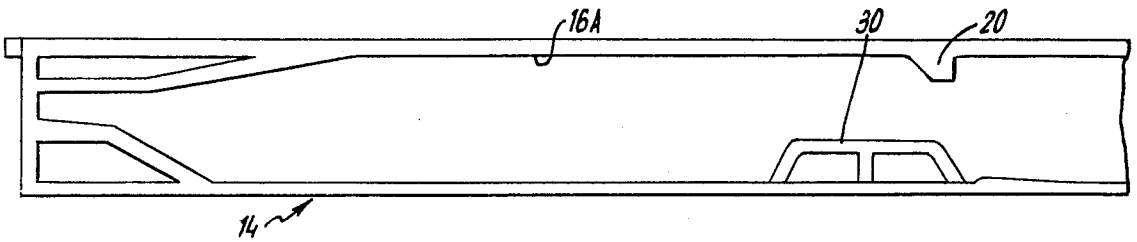
Figure 8:
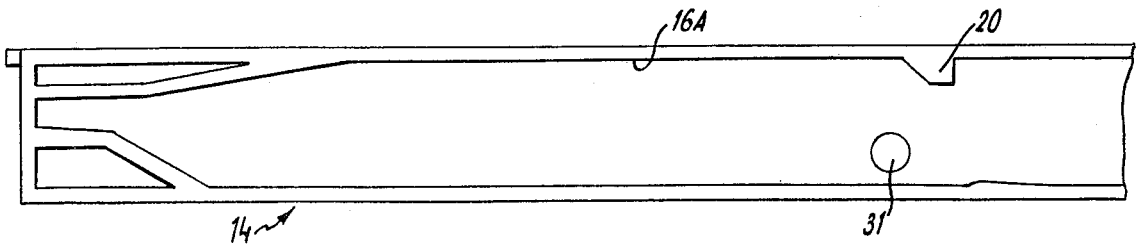
Figure 9:
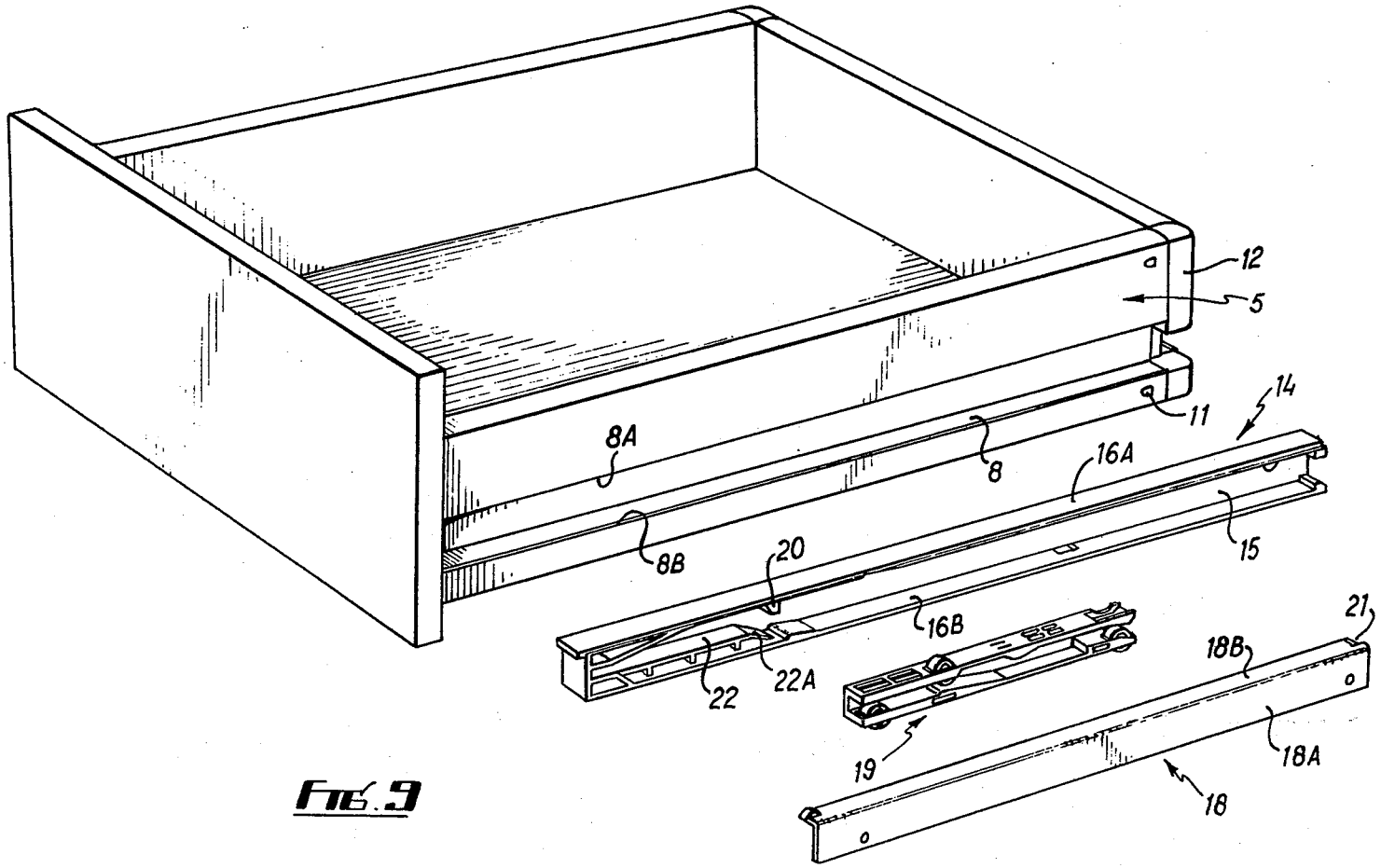
FIG. 9 is an exploded perspective view of the drawer and runner assembly shown in FIGS. 2 and 3.

FIG. 6 shows a modification of the arrangement shown in FIG. 5 in which the projection 29 is carried by the back wall 15 of the insert and is spaced from the floor 16B but is otherwise similarly positioned and operates in a similar fashion. FIG. 7 shows an alternative form of projection or ramp 30 mounted on the floor of the insert and spaced from the forward end and FIG. 8 shows the use of a stud or pin 31 in place of the projections or formations 28, 29 and 30 of FIGS. 5 to 7. In FIGS. 6 to 8 the upper wall 16A of the track is similar to that of FIG. 3 but could correspond to that of FIGS. 4 and 5 if desired.

Various other modifications may be made without departing from the invention. For example, other means of stabilising the drawer against rocking or lifting movement may be provided and where the stabilizing means comprises a raised formation of the kind described above, the length and position of the formation may be varied dependent on the construction and interrelation of the components of the drawer assembly. It should also be appreciated that while the invention has been described with reference to a drawer assembly in which the tracks in the drawer sides are formed by separate inserts, it is equally applicable to drawers in which the tracks are formed integrally with the drawer wall panels. Moreover while reference has been made to drawers constructed from plastics material and having hollow wall panels, the invention may also be applied to drawers of other construction.

I claim:

1. A drawer having longitudinally extending tracks in its opposite sides, each of which is adapted to co-operate with a drawer runner mounted in a cabinet in which the drawer is supported in use, a roller carriage engaged in each track and co-operable with the associated runner to support the drawer on the runner, the roller carriage being freely movable relative to the track and the runner, and each of said tracks incorporating a formation formed within the track in the form of a shelf raised from the base of the track and extending rearwardly from the forward end thereof, the shelf being adapted to engage beneath the associated runner and limit upward movement of the track and hence the drawer relative to the associated runner during initial opening and final closing movement of the drawer, whereby to stabilise the drawer against rocking or tilting movement during opening and closing.

2. A drawer according to claim 1 wherein said tracks are formed integrally with the drawer sides.

3. A drawer according to claim 1, wherein said tracks comprise inserts formed separately from the drawer sides and engaged and retained in recesses therein.

4. A drawer according to claim 3 wherein the drawer sides are of hollow section and formed by extrusion from synthetic plastics material, said inserts being formed from plastics material by a moulding process.

5. A drawer according to claim 4 wherein the drawer sides incorporate longitudinal slots in the faces thereof opposite to those in which said recesses are formed, the slots receiving the edges of the drawer bottom.

6. A drawer according to claim 5 wherein the drawer sides are connected to the front and back walls of the drawer by means of connecting pieces having projecting spigots which engage in the hollow ends of the side walls and are suitably retained therein.

7. A drawer according to claim 6 wherein said spigots are retained by means of detents projecting therefrom and engaging in holes formed adjacent the ends of the side walls.

8. A drawer according to claim 1, 2 or 3 wherein said tracks are provided with additional formations serving as stops and self-closing devices.

9. A drawer assembly comprising a drawer according to claim 1, 2 or 3 and a pair of drawer runners, the drawer runners incorporating drawer-engaging flanges adapted to extend into said tracks, and said roller carriages being engaged with the drawer-supporting flange of the associated runner.

10. A drawer runner insert comprising an elongated member adapted to be engaged and retained in a recess in a drawer side to form a runner track adapted to slidably receive a roller carriage for engagement with and movement relative to an associated one of a pair of drawer runners on which the drawer is slidably mounted in use, the track incorporating means to stabilize the drawer against rocking or tilting movement about said roller carriage during sliding movement of the drawer on the associated runners, said insert being of generally U-shaped cross-section and said means to stabilize the drawer comprising a formation in the form of a shelf on the side wall of the insert which forms the base of the runner track in use, and extending rearwardly from the end of the insert which is forwardmost in use.

11. A drawer runner insert comprising an elongated member adapted to be engaged and retained in a recess in a drawer side to form a runner track adapted to slidably receive a roller carriage for engagement with and movement relative to an associated one of a pair of drawer runners on which the drawer is slidably mounted in use, the track incorporating means to stabilize the drawer against rocking or tilting movement about said roller carriage during sliding movement of the drawer on the associated runners, said insert being of generally U-shaped cross-section and said means to stabilize the drawer comprising a formation in the form of a projection on or adjacent the side wall of the insert which forms the base oc the runner track in use, and towards the forward end thereof.

12. A drawer runner insert according to claim 11 incorporating additional formations acting as stops and self-closing devices.

* * * * *